US006436340B1

(12) United States Patent
Shiotani et al.

(10) Patent No.: US 6,436,340 B1
(45) Date of Patent: Aug. 20, 2002

(54) WEATHERABLE STEEL MATERIAL

(75) Inventors: Kazuhiko Shiotani; Akio Ohmori; Kimihiro Nishimura, all of Okayama; Yasuyoshi Yamane, Chiba; Fumimaru Kawabata; Keniti Amano, both of Okayama, all of (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/485,265

(22) PCT Filed: Jun. 17, 1999

(86) PCT No.: PCT/JP99/03222

§ 371 (c)(1),
(2), (4) Date: Feb. 24, 2000

(87) PCT Pub. No.: WO99/66093

PCT Pub. Date: Dec. 23, 1999

(30) Foreign Application Priority Data

Jun. 17, 1998 (JP) ..... 10-169559

(51) Int. Cl.[7] ..... C22C 38/16; C22C 38/02

(52) U.S. Cl. ..... 420/92; 420/119; 148/332; 148/336

(58) Field of Search ..... 420/119, 92, 121, 420/123; 148/332, 336

(56) References Cited

U.S. PATENT DOCUMENTS 4,298,661 A 11/1981 Ikeno et al.

FOREIGN PATENT DOCUMENTS

| | | | |
|---|---|---|---|
| JP | 363255341 A | * | 10/1988 |
| JP | 407207340 A | * | 8/1995 |
| JP | 09-100573 | | 4/1997 |

* cited by examiner

*Primary Examiner*—Deborah Yee
(74) *Attorney, Agent, or Firm*—Schnader Harrison Segal & Lewis LLP

(57) ABSTRACT

Steel is obtained which comprises by wt %, C: 0.001–0.025%, Si: not more than 0.60%, Mn: 0.10–3.00%, P: 0.005–0.030%, S: not more than 0.01%, Al: not more than 0.10%, Cu: 0.1–1.5%, Ni: 0.1–6.0%, B: 0.0001–0.0050%, and the balance being Fe and inevitable impurities; since the steel contains C and P in small contents, stable amorphous rusts are formed on the surface thereof at an early stage; and steel simultaneously realizes excellent weather resistance, material weldability and toughness particularly in an environment such as a seashore district and the like where salt is present in a large amount.

13 Claims, 2 Drawing Sheets

WEATHERABLE STEEL MATERIAL

TECHNICAL FIELD

The present invention relates to a weather resistant steel, and more particularly, to steel having excellent seashore weather resistance, capable of being used in a salty environment such as a seashore district and the like where a large amount of salt is present. The seashore weather resistance described here is the weather resistance of steel when it is used in a salty atmosphere in a seashore district.

BACKGROUND ART

Weather resistant steel whose corrosion resistance in the atmosphere is improved by adding alloy elements such as Cu, Cr, Ni, etc. to it has been widely used in structures such as bridges and the like. In weather resistant steel, rusts called stable rusts, which oxygen and water acting as a cause of rusts cannot easily penetrate, are formed on the steel in several years and thereafter the corrosion of the steel is suppressed by the stable rusts. As a result, the weather resistant steel is a less expensive highly corrosion resistant material which can be used effectively because it need not be coated with a rust-preventing paint.

In contrast, according to a guide for application of weather resistant steel recently made public by Ministry of Construction ("Report of Joint Researches on the Application of Weather Resistant Steel to Bridges" (XX), 1993.3, published by Public Works Research Institute of Ministry of Construction, The Kozai Club and Japan Association of Steel Bridge Construction), conventional weather resistant steel (JIS G 3114: weather resistant hot rolled steel used for welded structure) cannot be used without painting in a region where the amount of airborne salt is not less than $0.05/dm^2/day$, that is, in a seashore district.

Therefore, ordinary steel is coated with phthalic resin, chlorinated rubber, tar epoxy resin, etc. in an environment such as the seashore district and the like where a large amount of salt is present, to cope with this regulation. Bridges constructed in the seashore district near the mouth of a river are severely corroded and it is often required to repaint them. However, many of them are long bridges where a repaint job is often difficult. Such being the case, there is still a request for steel which can be used without painting.

Further, the amount of airborne salt is greatly different depending upon the location of seashore districts.

Since an increase in the amount of airborne salt more severely corrodes steel, weather resistant steel corresponding to an amount of airborne salt is necessary from the view point of corrosion resistance and cost efficiency.

Further, the corrosion environment of steel used in bridges is not always the same depending upon the locations where the steel is used. For example, a portion outside a girder is exposed to rain, dew-condensed water and sunshine, whereas a portion inside the girder is exposed only to the dew-condensed water and is not exposed to rain. In general, it is said that the portion inside the girder is more violently corroded than the portion outside the girder in the environment where a larger amount of airborne salt is present.

To cope with the above problem, Japanese Unexamined Patent Publication No. 6-136557, for example, proposes a steel surface treatment method of applying a chromium sulfate aqueous solution or a copper sulfate aqueous solution to steel and further coating the steel with an organic resin film after water is dried. Further, Japanese Unexamined Patent Publication No. 8-13158 proposes a steel surface treatment method of applying an aqueous water solution containing aluminum ions to steel and further forming an organic resin film on the steel after water is dried. However, such process is complicated and a surface treatment agent to be used is expensive. These problems still remain in the technologies disclosed in Japanese Unexamined Patent Publication No. 6-136557 and Japanese Unexamined Patent Publication No. 8-13158, although stable rusts can be formed thereby in a short period of time. Thus, it has been desired to develop weather resistant steel which needs no surface treatment.

As to this point, Japanese Unexamined Patent Publication No. 63-255341 proposes a corrosion resistive steel plate for welded structure excellent in salt damage resistance. The steel plate contains P:0.04–0.15 wt %, Cu: 0.1–0.5 wt %, Cr: 3–10 wt %, and Al: 0.02–1.0 wt %, and it is said that the steel plate can be used without painting in a corrosive environment in which sea salt particles are concerned. However, since the steel plate contains a large amount of P, it has a problem that the toughness and weldability thereof are greatly lowered.

Further, Japanese Unexamined Patent Publication No. 3-158436 proposes seashore weather resistant structural steel. It is said that the steel exhibits excellent weather resistance in a seashore district by adjusting the contents of Mn, Cu, Cr, Ni and Mo without adding P in a large amount and painting thereof can be omitted.

However, a problem still remains in that the toughness and weldability of the steel are lowered because it contains Cr in a large amount.

In view of the above problems, an object of the present invention is to provide weather resistant steel which does not need painting, surface treatment or the like, and exhibits excellent seashore weather resistance corresponding to an amount of airborne salt even in such an environment as a seashore district and the like, where salt is present in a large amount and no rain cover is available.

DISCLOSURE OF THE INVENTION

A rust layer, which is formed at the initial stage of rusting weather resistant steel, is mainly composed of γ-FeOOH and $Fe_3O_4$. When the rust layer is subjected to a corrosion reaction by being repeatedly dampened and dried for several years, the contents of γ-FeOOH and $Fe_3O_4$ are reduced from the rust layer and it is mainly composed of amorphous rusts when observed using X-rays.

The ratio of the amorphous rusts in the rust layer formed on weather resistant steel exposed in a seashore district is smaller than that of weather resistant steel exposed in a non-seashore district. Accordingly, the ratio of amorphous rusts in a rust layer must be increased to provide steel with excellent seashore weather resistance.

As a result of diligent study, the inventors found that the ratio of the amorphous rust could be satisfactorily increased by reducing the C content of the components of steel. FIG. 1 shows the effect of the C content in steel, when the C content was varied, on the existing ratio (wt %) of amorphous rust in the rust layer formed after the steel was exposed to the salty environment where $0.8\ mg/dm^2/day$ of airborne salt was present when it was measured by a method to be described later. The steel contained, by wt %, a basic component of 0.3% Si—1.0% Mn—2.7% Ni—0.4% Cu—0.0018% B. The existing ratio of the amorphous rust was increased by a decrease of the C content. Then, the existing ratio of the amorphous rust exhibited a high value of not less than 55% when the C content was 0.025% or less. FIG. 2 shows the relationship between the existing ratio of the amorphous rusts and the reduced amount of a sheet thickness at the time. It can be understood from FIG. 2 that the existing ratio of the amorphous rusts is large, the reduced amount of sheet thickness is made small. It is needless to say that the larger existing ratio of the amorphous rusts decreases the reducing speed of sheet thickness after the steel is exposed for one year.

The existing ratio of the amorphous rusts to the crystalline rusts is a value obtained by measuring the content of crystalline rusts (weight) in a rust layer formed using X-ray diffraction, determining the weight of amorphous rusts by subtracting the weight of the crystalline rusts from the total weight of the rusts and dividing the weight of the amorphous rusts by the total weight of the rusts.

The present invention is based on the above knowledge.

That is, the present invention is a weather resistant steel which comprises, by wt %, C: 0.001–0.025%, Si: not more than 0.60%, Mn: 0.10–3.00%, P: 0.005–0.030%, S: not more than 0.01%, Al: not more than 0.10%, Cu: 0.1–1.5%, Ni: 0.1–6.0%, B: 0.0001–0.0050%, and the balance being Fe and inevitable impurities.

Further, we have found that weather resistance can be further improved by adjusting the content of B and the contents of one or more of P, Cu, Ni and Mo according to a formula (1) in relation to the content of salt.

$$(11P+4.0Cu+3.1Ni+2.6Mo)/(1-0.1(10000\ B)^{0.35})\geqq 1+13X \qquad (1)$$

(where, P, Cu, Ni, Mo and B: contents of respective elements (wt %), and X: content of airborne salt ($mg/dm^2/day$)).

The value X is measured by a gauze method regulated by JIS Z 2381.

Further, in the present invention, one or two or more of Nb: 0.005–0.20%, Ti: 0.005–0.20 and V: 0.005–0.20% may be further present by wt %, in addition to the above components. Furthermore, in the present invention, REM: not more than 0.02% may be further present, in addition to the above components.

BEST MODE OF CARRYING OUT THE INVENTION

Figure 1:
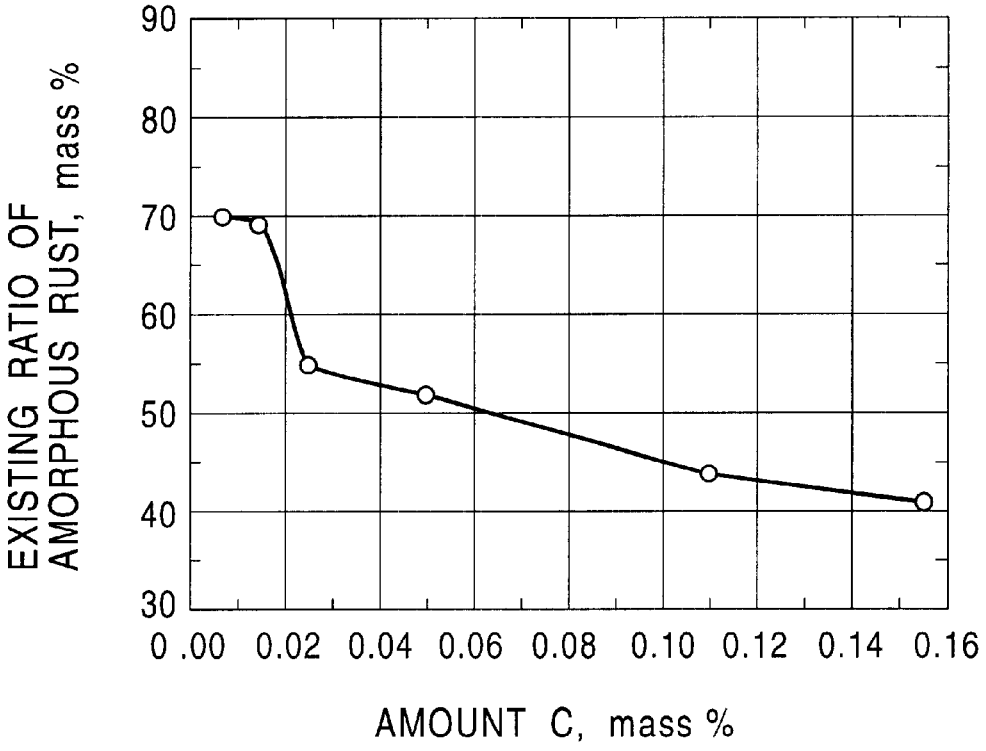
FIG. 1 shows the effect of C content on the existing ratio of amorphous rusts (0.3Si—1.0Mn—2.7Ni—0.4Cu—0.0018B, one year after exposure (the amount of airborne salt was: 0.8 $mg/dm^2/day$)).
Figure 2:
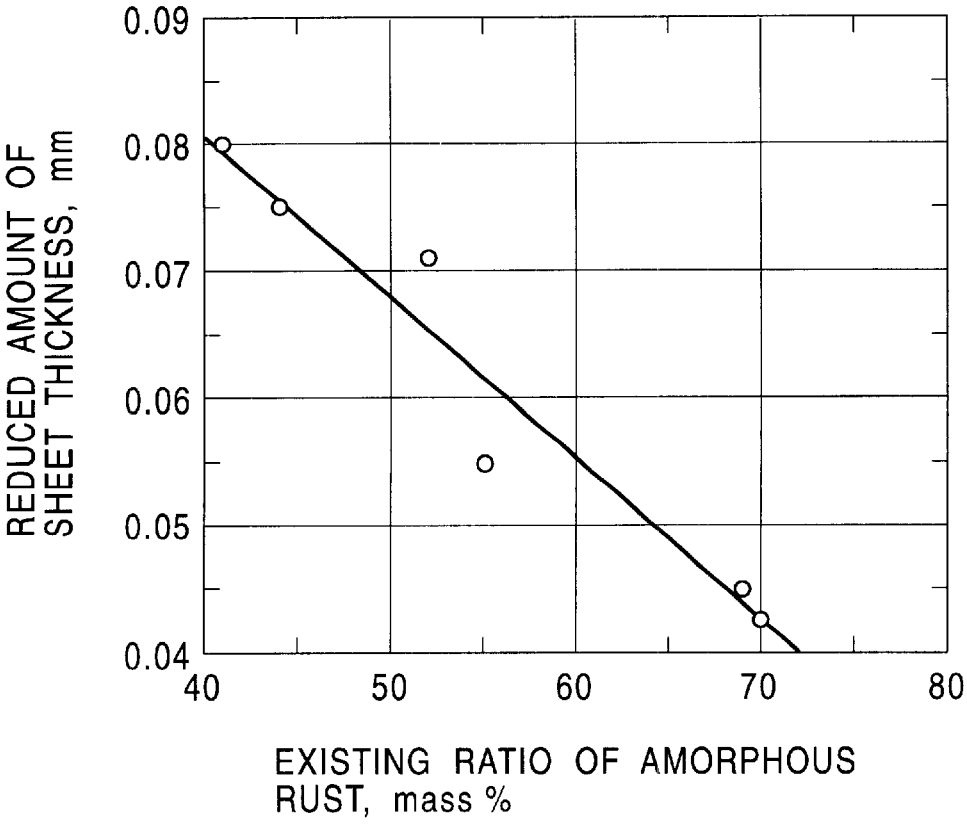
FIG. 2 shows the relationship between the existing ratio of the amorphous rusts and the reduced amount of a sheet thickness (0.3Si—1.0Mn—2.7Ni—0.4Cu—0.0018B, one year after exposure (amount of airborne salt: 0.8 $mg/dm^2/day$)).

Reasons why it is advantageous for the contents of steel of the present invention to be limited will be described.

As described above, the reduction of C content increases the ratio of amorphous rusts in a rust layer, which is advantageous to the improvement of weather resistance. However, C content which is not less than 0.025% is less effective. Further, toughness and weldability are deteriorated by a C content which is not less than 0.025%. When the C content is not more than 0.001%, desired strength cannot be secured. Thus, the C content is limited to 0.001–0.025%. Further, the C content is preferably to 0.001–0.02%.

Si: not more than 0.60%.

Si acts as an deoxidizer and further is an element for increasing the strength of steel. However, when it is present in a large amount, toughness and weldability are deteriorated. Thus, the Si content is limited to not more than 0.60%. It is preferably 0.15–0.50%. Mn: 0.10–3.00%

Mn is an element which greatly contributes to an increase of the strength and toughness of steel. A Mn content which is not less than 0.10% is required in the present invention to secure a desired strength. However, when Mn is present in a large amount exceeding 3.00%, the toughness and weldability of the steel is adversely affected thereby. Thus, the Mn content is limited in the range of 0.10–3.00%. When high toughness is required in a cold district and the like, it is effective to reduce the Mn content. S: not more than 0.01%

Since S deteriorates weather resistance and further deteriorates weldability and toughness, S content is limited to not more than 0.01%.

Al: not more than 0.10%

Al is added as a deoxidizer. However, the upper limit thereof is set at 0.01% because it adversely affects weldability when contained in an amount exceeding 0.10%.

B: 0.0001–0.0050%

B is an important element in the present invention because it increases the hardening property and further improves weather resistance. These effects can be admitted in a content which is not less than 0.0001%. However, even if it is present in an amount exceeding 0.0050%, effects corresponding to the content cannot be expected. Thus, B content is limited to the range of 0.0001–0.0050%. Preferably, it is in the range of 0.0003–0.0030%. Note that while a detailed mechanism of B by which weather resistance is improved is not apparent, it is contemplated as described below. That is, salt deposited in a rust layer is ionized by rain and dew-concentrated water (or deliquescence) and converted to Cl ions which reduce the pH in the rust layer. The reduction of pH promotes anode dissolution of iron and deteriorates weather resistance. It is contemplated that B has an action preventing the reduction of pH caused by chlorine.

One kind or two or more kinds selected from P: 0.005–0.030%, Cu: 0.1–1.5%, Ni: 0.1–6.0%, Mo: 0.005–0.5%

Since any of P, Cu, Ni and Mo has an action for making rust particles fine and improving weather resistance, one kind or two or more kinds of them are contained in the present invention.

P: 0.005–0.030%

P is an element for making rust particles fine and improving weather resistance. However, when P content is less than 0.005%, these effects cannot be admitted. However, when the P content exceeds 0.030%, weldability is deteriorated. Thus, the P content is limited to the range of 0.005–0.030%.

Cu: 0.1–1.5%

Cu makes rust particles fine and improves weather resistance. However, a Cu content less than 0.1% is less effective, whereas the Cu content exceeding 1.5% will injure the hot rolling property as well as saturate the weather resistance improving effect, and such a content is disadvantageous in cost efficiency. Thus, the Cu content is limited to the range of 0.1–1.5%.

Ni: 0.1–6.0%

Ni makes rust particles fine and improves weather resistance. However, a Ni content less than 0.1% is less effective, whereas even if the Ni content exceeds 6.0%, an effect corresponding to the content cannot be admitted because the effect is saturated, and such a content is disadvantageous in cost efficiency. Thus, the Ni content is set to the range of 0.1–6.0%. It is preferable that Ni is provided in a larger amount when salt is airborne in a large amount.

However, the Ni content is preferably in the range of 2.0–3.5% and more preferably in the range of 2.5–3.0% when cost efficiency is taken into consideration.

Mo: 0.005–0.5%

While Mo improves weather resistance and further increases strength, a Mo content less than 0.005% is less effective. In contrast, the Mo content exceeding 0.5% will saturate these effect and effects corresponding to the content cannot be admitted, and the content is disadvantageous in cost efficiency. Thus, the Mo content is set to the range of 0.005–0.5%. Note that the Mo content is set in the range of 0.005–0.35% from the view point of toughness. Further, in the present invention, the B content and the content of one or more kinds of P, Cu, Ni and Mo are adjusted so as to satisfy the following formula (1) in relation to an amount of airborne salt.

Seashore weather resistance in a seashore district where the content of airborne salt X is large can be greatly improved by adjusting the B content and the contents of the one or more kinds of P, Cu, Ni and Mo so as to satisfy the formula (1). Steel capable of coping with a corrosion environment can be provided by adjusting the contents of B, P, Cu, Ni and Mo in accordance with the content of fly-coming salt X, which is advantageous in cost efficiency because the addition of unnecessary alloy metals can be prevented.

When the left side of the formula (1)

$$A=(11p+4.0Cu+3.1Ni+2.6Mo)/(1-0.1(10000\ B)^{035})$$

is smaller than the right side thereof $$B=1+13X$$

that is, when A<B, the corrosion resistance deteriorating effect caused by airborne salt is larger than a corrosion resistance improving effect achieved by alloy elements. Note that, in the present invention, when some of the alloy elements in the formula (1) are not added, calculation is carried out by setting their contents to 0.

One kind or two or more kinds of Nb, Ti and V selected from Nb: 0.005–0.20%, Ti: 0.005–0.20%, V: 0.005–0.20% are elements for increasing the strength of steel, and one kind or two or more kinds of them can be added as necessary. While an effect can be admitted when Nb, Ti and V are added in an amount not less than 0.005%, the contents exceeding 0.20% will saturate the effect. Therefore, it is preferable that Nb, Ti and V are added in an amount of 0.005–0.20%.

REM has an action for improving weldability and can be added as necessary. While an effect can be obtained by the addition of REM in an amount not less than 0.001% is, the addition of it in a large amount will deteriorate the cleanliness of steel. Thus, the upper limit a REM content is set to 0.02%.

In addition to the above elements, the steel of the present invention contains Fe and inevitable impurities as the balance thereof. Elements permitted as the inevitable impurities are Cr: not more than 0.05%, N: not more than 0.010%, O: not more than 0.010%. It is said that Cr is an element for improving weather resistance. However, this is applicable when Cr is used in an environment where a smaller amount of salt is present and it deteriorates the weather resistance, on the contrary, in an environment where a large amount of salt is present such as the seashore district which is the object of the present invention. Thus, the permissible additive amount of Cr is up to 0.05%, while it is not intentionally added in the present invention.

The steel of the present invention is melted by an ordinary known melting method using a converter, an electric furnace or the like and made into a steel material by a continuous casting method or an ingot-making method. Further, vacuum degassing refining and the like may be carried out as the melting method.

Then, the steel material is heated in a heating furnace or the like. Otherwise, it is directly rolled to a desired shape by hot rolling without being heated. The steel of the present invention includes a thin sheet steel, a steel bar, a shape steel and the like in addition to a thick steel plate.

FIRST EMBODIMENT

Steel having the chemical components shown in Table 1 was melted in a converter, formed into a slab by continuous casting, and the slab was heated and then made to steel plates of 25 mm thick×2500 mm wide by hot rolling. The tensile strength characteristics and impact characteristics of the steel plates were examined. Further, a synthetic heat cycle corresponding to heat input of 100 kJ/cm and a welding-heat-affected zone of 1 mm was applied to the steel plates as weldability and the absorbed energy vE-5 of a Charpy impact test was determined at −5°. The result is shown in Table 2.

Further, corrosion test pieces 5 mm×50 mm×100 mm were sampled from these steel plates. After the test pieces were shot blasted, they were subjected to an atmospheric corrosion test. The atmospheric corrosion test was carried out in such a manner that a seashore district having an airborne salt content of 0.8 mg/dm2/day (measured by a gauze method of JIS Z 2381) was selected, each test piece was placed with its bare surface facing horizontally upward without a rain cover and exposed for one year. After the atmospheric corrosion test was finished, a rust layer formed on the bare surface was removed and the reduced weight of the test piece was measured and converted into the reduced amount of sheet thickness of the test piece. The result is shown in Table 1.

The examples of the present invention (steel plates No. 1–No. 10) have small reduced amounts of sheet thickness of 18–55 μm which are greatly reduced as compared with 143 μm of a conventional example (steel plate No. 19). Thus, it can be understood that the steel of the present invention has excellent weather resistance. In contrast, the reduced amounts of sheet thickness of comparative examples (steel plates No. 11–No. 16) outside of the scope of the present invention were 71–91 μm which are larger than those of the examples of the present invention. Thus, the weather resistance of the comparative examples deteriorated.

The C contents of the comparative examples (steel plates No. 11–No. 13) are outside of the scope of the present invention and the Cu content, Ni content and B content of the comparative examples (steel plates Nos. 14, 15 and 16) are outside of the scope thereof, respectively. Accordingly, the sheet thicknesses of the comparative examples are greatly reduced and the weather resistance thereof is deteriorated.

From the results of tests No. 1, 3, 5 and 8, an increase in the Ni content decreased the reduced amount of sheet thickness, and it can be also understood that the addition of Ni is effective to give weather resistance.

Further, the toughness and weldability of the comparative examples (steel plates No. 17 and No. 18) deteriorated while the weather resistance thereof was similar to the examples of the present invention because the P and Cu contents thereof exceed the scope of the present invention.

The examples of the present invention (steel plates No. 1 to No. 10) were excellent in both toughness and weldability.

In contrast, the toughness and weldability of the comparative examples (steel plates No. 11–No. 19) are similar to those of the examples of the present invention except that they deteriorated when the C, Cu and P contents thereof were outside of the upper limit of the scope of the present invention.

SECOND EMBODIMENT

Steel having the chemical component shown in Table 3 was melted in a converter, made to a slab by continuous casting, and the slab was heated and then made to steel plates of 25 mm thick×2500 mm wide by hot rolling. The tensile strength characteristics and impact characteristics of the steel plates were examined. Further, a synthetic heat cycle corresponding to heat input of 100 kJ/cm and a welding-heat-affected zone of 1 mm was applied to the steel plates as weldability and the absorbed energy vE-5 of a Charpy impact test was determined at −5°. The result is shown in Table 4.

Further, corrosion test pieces of 5 mm×50 mm×100 mm were sampled from these steel plates. After the test pieces were shot blasted, they were subjected to an atmospheric corrosion test. The atmospheric corrosion test was carried out in such a manner that a seashore district having an airborne salt content of 0.45 mg/dm2/day (measured by a gauze method of JIS Z 2381) was selected, each test piece was placed with its bare surface facing horizontally upward in a condition without a rain cover and exposed for one year. After the atmospheric corrosion test was finished, the rust layer formed on the bare surface was removed and the reduced weight of the test piece was measured and converted into the reduced amount of sheet thickness of the test piece similarly to the first embodiment. The result is shown in Table 3.

Next, the result of the atmospheric corrosion test will be described.

The examples of the present invention (steel plates No. 20–No. 26) had reduced amounts of sheet thickness of 32–54 μm which were greatly smaller than 105 μm of a conventional example (steel plate No. 30). Thus, the steel of the present invention had excellent weather resistance.

In contrast, the weather resistance of comparative examples (steel plates Nos. 27–33) was deteriorated because C, S, Cu, Ni and B exceeded the scope of the present invention, respectively.

Note that the examples of the present invention (steel plates No. 20–No. 26) were excellent in both toughness and weldability. In contrast, the toughness and weldability of comparative examples (steel plates Nos. 27–No. 33) were similar to those of the examples of the present invention except that they deteriorated when the C and S contents thereof were outside of the upper limit of the scope of the present invention.

Further, in the first and second embodiments, the rust layers formed on the surface of the steels were removed and the rusts were subjected to X-ray diffraction to thereby measure the contents (weights) of crystalline rusts, the weights of amorphous rusts were determined by subtracting the weights of the crystalline rusts from the total weights of the rusts, and the existing ratios of the amorphous rusts were determined by dividing the weight values of the amorphous rusts by the total weights of the rusts. The existing ratios of the amorphous rusts were not less than 55% in the scope of the present invention.

TABLE 1

| | Type of steel | Chemical composition (mass %) | | | | | | | | | | | | | | | Value | Value | Value |
|---|---|---|---|---|---|---|---|---|---|---|---|---|---|---|---|---|---|---|---|
| | No. | C | Si | Mn | P | S | Al | Cu | Ni | B | Mo | Nb | Ti | V | REM | Cr | A | B | C |
| Invented | 1 | 0.015 | 0.30 | 1.38 | 0.010 | 0.002 | 0.032 | 0.38 | 1.50 | 0.0015 | | | | | | | [illegible] | 11.4 | 55 |
| steel | 2 | 0.015 | 0.30 | 1.38 | 0.025 | 0.003 | 0.032 | 0.45 | 1.51 | 0.0014 | 0.2 | | | 0.04 | | | [illegible] | 11.4 | 53 |
| | 3 | 0.018 | 0.30 | 1.15 | 0.012 | 0.002 | 0.031 | 0.41 | 2.20 | 0.0016 | | | | | | | 11.7 | 11.4 | 49 |
| | 4 | 0.015 | 0.30 | 1.05 | 0.010 | 0.002 | 0.029 | 0.41 | 2.71 | 0.0018 | | 0.015 | 0.014 | | | | 14.0 | 11.4 | 3 |
| | 5 | 0.025 | 0.34 | 1.03 | 0.015 | 0.003 | 0.030 | 0.40 | 2.69 | 0.0028 | 0.1 | | | | | | 15.3 | 11.4 | 32 |
| | 6 | 0.016 | 0.33 | 1.05 | 0.015 | 0.004 | 0.029 | 0.38 | 2.72 | 0.0017 | | 0.028 | 0.013 | | | | 13.9 | 11.4 | 37 |
| | 7 | 0.025 | 0.34 | 1.03 | 0.015 | 0.005 | 0.030 | 0.40 | 2.69 | 0.0028 | | 0.035 | | | 0.006 | | 14.9 | 11.4 | 38 |
| | 8 | 0.018 | 0.36 | 0.20 | 0.011 | 0.002 | 0.026 | 0.29 | 5.08 | 0.0015 | | | 0.011 | | | | 23.0 | 11.4 | 18 |
| | 9 | 0.018 | 0.31 | 0.67 | 0.012 | 0.002 | 0.034 | 0.41 | 3.20 | 0.0013 | | 0.013 | 0.013 | | | | 15.5 | 11.4 | 30 |
| | 10 | 0.015 | 0.29 | 0.40 | 0.009 | 0.002 | 0.032 | 0.29 | 3.98 | 0.0015 | | | 0.011 | | | | 18.3 | 11.4 | 26 |
| Compara- | 11 | [illegible] | 0.30 | 1.05 | 0.025 | 0.005 | 0.029 | 0.38 | 2.71 | 0.0018 | | | | | | | 14.1 | 11.4 | 71 |
| tive | 12 | [illegible] | 0.32 | 1.02 | 0.012 | 0.005 | 0.028 | 0.45 | 2.70 | 0.0018 | | | | | | | [illegible] | 11.4 | 75 |
| steel | 13 | [illegible] | 0.30 | 1.01 | 0.015 | 0.002 | 0.030 | 0.44 | 2.69 | 0.0018 | | | | | | | 14.2 | 11.4 | 80 |
| | 14 | 0.016 | 0.28 | 1.05 | 0.015 | 0.006 | 0.029 | [illegible] | 2.00 | 0.0017 | | | | | | | [illegible] | 11.4 | 82 |
| | 15 | 0.025 | 0.31 | 1.38 | 0.020 | 0.006 | 0.033 | 1.03 | [illegible] | 0.0017 | | | | | | | [illegible] | 11.4 | 91 |
| | 16 | 0.015 | 0.25 | 1.02 | 0.017 | 0.005 | 0.027 | 0.45 | 2.04 | [illegible] | | | | | | | [illegible] | 11.4 | 8 |
| | 17 | 0.025 | 0.35 | 1.38 | [illegible] | 0.007 | 0.030 | 1.02 | 1.50 | 0.0024 | | | | | | | 13.5 | 11.4 | 52 |
| | 18 | 0.024 | 0.33 | 1.31 | 0.020 | 0.005 | 0.031 | [illegible] | 1.50 | 0.0025 | | | | | | | 16.3 | 11.4 | 29 |

TABLE 1-continued

| Type of steel | Chemical composition (mass %) | | | | | | | | | | | | | | | Value | Value | Value |
|---|---|---|---|---|---|---|---|---|---|---|---|---|---|---|---|---|---|---|
| No. | C | Si | Mn | P | S | Al | Cu | Ni | B | Mo | Nb | Ti | V | REM | Cr | A | B | C |
| 19 | 0.110 | 0.40 | 1.38 | 0.020 | 0.005 | 0.025 | 0.35 | 0.15 | [illegible] | | | | | | 0.55 | 7.1 | 11.4 | 143 |

Value A = (11P + 4.0Cu + 3.1Ni + 2.6Mo)/(1 − 0.1 (10000B)$^{0.35}$)
Value B = 1 + 13X X: amount of fly-coming salt
Value C = reduced amount of sheet thickness (μm), exposure at the seaside (0.8 mg/dm$^2$/day)
[illegible]: outside of the scope of invention

TABLE 2

| Type of steel No. | Tensile strength properties | | | Toughness vE-5 J | Weldability vE-5 J |
|---|---|---|---|---|---|
| | Yield strength MPa | Tensile strength MPa | Elongation MPa | | |
| 1 | 461 | 601 | 31 | 285 | 244 |
| 2 | 509 | 714 | 26 | 240 | 180 |
| 3 | 511 | 625 | 26 | 251 | 201 |
| 4 | 492 | 632 | 30 | 271 | 203 |
| 5 | 508 | 648 | 29 | 265 | 198 |
| 6 | 489 | 629 | 30 | 272 | 204 |
| 7 | 488 | 628 | 30 | 273 | 285 |
| 8 | 513 | 653 | 29 | 368 | 321 |
| 9 | 495 | 641 | 31 | 320 | 298 |
| 10 | 497 | 632 | 30 | 342 | 307 |
| 11 | 489 | 629 | 30 | 150 | 58 |

TABLE 2-continued

| Type of steel No. | Tensile strength properties | | | Toughness vE-5 J | Weldability vE-5 J |
|---|---|---|---|---|---|
| | Yield strength MPa | Tensile strength MPa | Elongation MPa | | |
| 12 | 492 | 632 | 30 | 102 | 41 |
| 13 | 490 | 630 | 30 | 87 | 32 |
| 14 | 420 | 560 | 34 | 306 | 229 |
| 15 | 454 | 594 | 32 | 289 | 216 |
| 16 | 459 | 599 | 31 | 286 | 214 |
| 17 | 585 | 721 | 26 | 57 | 25 |
| 18 | 576 | 735 | 26 | 62 | 27 |
| 19 | 391 | 531 | 36 | 323 | 52 |

TABLE 3

| | Type of steel | Chemical composition (mass %) | | | | | | | | | | | | | | | Value | Value | Value |
|---|---|---|---|---|---|---|---|---|---|---|---|---|---|---|---|---|---|---|---|
| | No. | C | Si | Mn | P | S | Al | Cu | Ni | B | Mo | Nb | Ti | V | REM | Cr | A | B | C |
| Invented steel | 20 | 0.018 | 0.29 | 1.32 | 0.009 | 0.006 | 0.031 | 0.30 | 0.70 | 0.0020 | | 0.045 | 0.013 | | | | [illegible] | 6.9 | 54 |
| | 21 | 0.020 | 0.28 | 1.35 | 0.021 | 0.005 | 0.030 | 1.00 | 0.71 | 0.0021 | 0.4 | | | | | | 10.5 | 6.9 | 32 |
| | 22 | 0.015 | 0.31 | 1.33 | 0.010 | 0.006 | 0.032 | 0.38 | 1.12 | 0.0022 | | 0.040 | | | | | 7.2 | 6.9 | 41 |
| | 23 | 0.021 | 0.32 | 1.54 | 0.009 | 0.006 | 0.029 | 0.41 | 1.10 | 0.0029 | 0.2 | | | | | | 8.4 | 6.9 | 37 |
| | 24 | 0.015 | 0.30 | 1.32 | 0.013 | 0.005 | 0.029 | 0.43 | 1.15 | 0.0014 | | 0.035 | 0.011 | | | | 7.3 | 6.9 | 41 |
| | 25 | 0.016 | 0.31 | 1.33 | 0.020 | 0.005 | 0.031 | 0.41 | 1.15 | 0.0013 | | | | | 0.006 | | 7.2 | 6.9 | 43 |
| | 26 | 0.015 | 0.33 | 1.35 | 0.025 | 0.005 | 0.030 | 0.40 | 1.61 | 0.0014 | | | 0.013 | | | | 9.2 | 6.9 | 33 |
| Comparative steel | 27 | [illegible] | 0.28 | 1.02 | 0.005 | 0.005 | 0.028 | 0.45 | 1.10 | 0.0018 | | | | | | | 7.3 | 6.9 | 71 |
| | 28 | [illegible] | 0.31 | 1.01 | 0.007 | 0.002 | 0.030 | 0.44 | 1.12 | 0.0018 | | | | | | | 7.3 | 6.9 | 75 |
| | 29 | 0.016 | 0.30 | 1.31 | 0.051 | [illegible] | 0.030 | 0.39 | 1.11 | 0.0018 | | | | | | | 7.7 | 6.9 | 85 |
| | 30 | 0.014 | 0.29 | 1.38 | 0.051 | 0.006 | 0.028 | [illegible] | 1.10 | 0.0017 | | | | | | | [illegible] | 6.9 | 82 |
| | 31 | 0.025 | 0.30 | 1.40 | 0.052 | 0.006 | 0.033 | 1.02 | [illegible] | 0.0017 | | | | | | | [illegible] | 6.9 | 89 |
| | 32 | 0.014 | 0.25 | 1.43 | 0.052 | 0.005 | 0.028 | 0.40 | 1.11 | [illegible] | | | | | | | [illegible] | 6.9 | 75 |
| | 33 | 0.110 | 0.40 | 1.38 | 0.020 | 0.005 | 0.025 | 0.35 | 0.15 | [illegible] | | | | | | 0.55 | 7.1 | 11.4 | 105 |

Value A = (11P + 4.0Cu + 3.1Ni + 2.6Mo)/(1 − 0.1 (10000B)$^{0.35}$)
Value B = 1 + 13X X: amount of fly-coming salt
Value C = reduced amount of sheet thickness (μm), exposure at the seaside (0.8 mg/dm$^2$/day)
[illegible]: outside of the scope of invention

TABLE 4

| Type of steel No. | Tensile strength properties: Yield strength MPa | Tensile strength MPa | Elongation MPa | Toughness vE-5 J | Weldability vE-5 J |
|---|---|---|---|---|---|
| 20 | 457 | 572 | 33 | 319 | 240 |
| 21 | 611 | 712 | 26 | 257 | 192 |
| 22 | 487 | 602 | 31 | 304 | 228 |
| 23 | 550 | 665 | 28 | 275 | 206 |
| 24 | 493 | 608 | 31 | 301 | 298 |
| 25 | 492 | 607 | 31 | 301 | 226 |
| 26 | 516 | 631 | 30 | 290 | 217 |
| 27 | 462 | 577 | 33 | 198 | 78 |
| 28 | 461 | 576 | 33 | 163 | 45 |
| 29 | 486 | 601 | 31 | 45 | 15 |
| 30 | 457 | 572 | 33 | 319 | 240 |
| 31 | 505 | 620 | 30 | 295 | 221 |
| 32 | 499 | 620 | 30 | 298 | 223 |
| 33 | 391 | 531 | 36 | 323 | 52 |

INDUSTRIAL APPLICABILITY

According to the present invention, there can be provided a weather resistant steel which can maintain weather resistance even in an environment such as a seashore district and the like where salt is contained in a large amount and no rain cover is available.

That is, there can be obtained a weather resistant steel on which a stable amorphous rust layer can be formed at an early stage by reducing the C content.

When the steel is used for a structure such as a bridge and the like, painting, surface treatment and the like can be omitted and an economical effect of reducing a maintenance cost can be expected so that the present invention achieves an especial effect on industry.

What is claimed is:

1. An airborne salt atmosphere weathering steel in a seashore atmosphere comprising, by wt %, C: 0.001–0.025%, Si: 0.60% or less, Mn: 0.10–3.00%, P: 0.005–0.030%, S: 0.01% or less, Al: 0.10% or less, Cu: 0.01–1.5%, Ni: 0.1–6.0%, B: 0.0001–0.0050%, Cr: 0.05% or less, and the balance being Fe and inevitable impurities, said steel having the property of forming more amorphous rust than crystalline rust when exposed to an atmosphere containing salt, and said steel further comprising Mo:0.005–0.5% and satisfying the formula (1), $$(11P+4.0Cu+3.1Ni+2.6Mo)/(1-0.1(10000\ B)^{0.35})\geqq 1+13X \quad (1)$$

(where, P, Cu, Ni, Mo and B represent contents of respective elements (wt %), and X represents the content of airborne salt at said seashore atmosphere ($mg/dm^2/day$)).

2. A weathering steel according to claim 1, further comprising, by wt %, one kind or two or more kinds of Nb: 0.005–0.20%, V: 0.005–0.20%, Ti: 0.005–0.20%, and REM: 0.02% or less.

3. A weathering steel according to claim 1, further comprising, by wt %, Mo: 0.005–0.5%, satisfying the formula (1) and further comprising, by wt %, one kind or two or more kinds of Nb: 0.005–0.20%, V:0.005–0.20%, Ti: 0.005–0.20%, and REM: 0.02% or less.

4. A weathering steel according to claims 1 to 3, wherein the weathering steel is a thick plate.

5. A weathering steel according to claims 1 to 3, wherein the weathering steel is a thick plate exposed to seashore atmosphere.

6. A bridge comprising thick plates comprising weathering steel according to any of claims 1 to 3, wherein the bridge is located at a seashore.

7. A weathering steel comprising, by wt %, C: 0.001–0.025%, Si: not more than 0.60%, Mn: 0.10–3.00%, P: 0.005–0.030%, S: not more than 0.01%, Al: not more than 0.10%, Cu: 0.1–1.5%, Ni: 0.1–6.0%, B: 0.0001–0.0050%, and the balance being Fe and inevitable impurities and rusts formed on the surface of the steel, the existing ratio of amorphous rusts of the above rusts being 55% or more.

8. A weathering steel according to claim 7, further comprising Mo: 0.005–0.5% and satisfying the formula (1).

9. A weathering steel according to claim 7, further comprising, by wt %, one kind or two or more kinds of Nb: 0.005–0.20%, V: 0.005–0.20%, Ti: 0.005–0.20%, and REM: not more than 0.02%.

10. A weathering steel according to claim 7, further comprising, by wt %, Mo: 0.005–0.5%, satisfying the formula (1) and further coprising, by wt %, one kind or two or more kinds of Nb: 0.005–0.20%, V: 0.005–0.20%, Ti: 0.005–0.20%, and REM: not more than 0.02%.

11. A weathering steel according to claims 7 to 10, wherein the weathering steel is a thick plate.

12. A weathering steel according to claims 7 to 10, wherein the weathering steel is a thick plate used in seashore.

13. A weathering steel according to claims 7 to 10, wherein the weathering steel is a thick plate used for bridge in seashore.

* * * * *

UNITED STATES PATENT AND TRADEMARK OFFICE

CERTIFICATE OF CORRECTION

PATENT NO. : 6,436,340 B1
DATED : August 20, 2002
INVENTOR(S) : Shiotani et al.

It is certified that error appears in the above-identified patent and that said Letters Patent is hereby corrected as shown below:

Column 4,
Line 6, please put "MN: 0.10-3.00%" on a separate line, after line 6;
Lines 15 and 16, please put "S: not more than 0.01%" on a separate line, after line 16.

Column 5,
After line 55, on a separate line, please insert -- REM: not more than 0.029% --.

Column 8,
Table 1, no. 4, value C, please change "3" to -- 38 --; and
No. 16, at value C, please change "8" to -- 88 --.

Signed and Sealed this

Eighth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,436,340 B1
DATED : August 20, 2002
INVENTOR(S) : Shiotani et al.

It is certified that error appears in the above-identified patent and that said Letters Patent is hereby corrected as shown below:

Column 5,
After line 23, please insert:
-- $(11P+4.0\ Cu+3.1\ Ni = 2.6\ Mo)/(1-0.1(10000B)^{0.35}) \geq 1+13x$…(1) where, P, Cu, Ni, Mo and B: contents of respective elements (wt%), X:content of fly-coming salt ($mg/dm^2$) day) --.

Signed and Sealed this

Sixteenth Day of December, 2003

JAMES E. ROGAN
*Director of the United States Patent and Trademark Office*